US006883243B2

(12) United States Patent
Ramcke

(10) Patent No.: US 6,883,243 B2
(45) Date of Patent: Apr. 26, 2005

(54) METHOD AND DEVICE FOR DETECTING THE CONTOUR OF A BODY

(75) Inventor: Hubert Ramcke, Pinneberg (DE)

(73) Assignee: Atways AG, Hamburg (DE)

( * ) Notice: Subject to any disclaimer, the term of this patent is extended or adjusted under 35 U.S.C. 154(b) by 0 days.

(21) Appl. No.: 10/490,174

(22) PCT Filed: Dec. 17, 2002

(86) PCT No.: PCT/DE02/04616

§ 371 (c)(1),
(2), (4) Date: Mar. 19, 2004

(87) PCT Pub. No.: WO03/056957

PCT Pub. Date: Jul. 17, 2003

(65) Prior Publication Data

US 2004/0237323 A1 Dec. 2, 2004

(30) Foreign Application Priority Data

Dec. 21, 2001 (DE) ..... 101 63 745

(51) Int. Cl.[7] ..... G01B 5/20

(52) U.S. Cl. ..... 33/561.2; 33/15; 33/17 R; 33/514.2

(58) Field of Search ..... 33/14, 15, 17 R, 33/512, 514.2, 561.1, 561.2, 561.3; 73/862.621; 700/132

(56) References Cited

U.S. PATENT DOCUMENTS

| | | | | |
|---|---|---|---|---|
| 1,935,998 A | | 11/1933 | Stradling | 33/15 |
| 3,832,780 A | | 9/1974 | Lewis | 33/15 |
| 4,913,162 A | * | 4/1990 | Leang et al. | 33/512 |
| 4,998,354 A | * | 3/1991 | Silverman et al. | 33/561.1 |
| 5,747,676 A | | 5/1998 | Faust et al. | 73/862.621 |
| 6,415,199 B1 | * | 7/2002 | Liebermann | 700/132 |
| 6,546,309 B1 | * | 4/2003 | Gazzuolo | 700/132 |
| 6,550,149 B1 | * | 4/2003 | Dowdell | 33/512 |
| 6,615,504 B1 | * | 9/2003 | Oser | 33/512 |

FOREIGN PATENT DOCUMENTS

| | | |
|---|---|---|
| DE | 223599 | 9/1909 |
| DE | 2506295 | 8/1976 |
| DE | 59051 | 3/1991 |
| DE | 4224827 | 1/1994 |
| DE | 199 56 574 A1 | 5/2001 |
| EP | 0128146 | 4/1988 |
| WO | 0070976 | 11/2000 |

* cited by examiner

*Primary Examiner*—G. Bradley Bennett
(74) *Attorney, Agent, or Firm*—Friedrich Kueffner

(57) ABSTRACT

The method and device are used for at least regional determination of an outer contour of a body. For this purpose, a contour element is used which can be formed at least regionally according to an outer contour of the body. The shape of the contour element in a state formed by the body is stored by modifying at least one material property of the contour element. After elastic removal of the contour element from the body, another manipulation of the contour element is carried out in such a way that the shape of the contour element in the state formed by the body is determined by evaluating the modified material property.

33 Claims, 3 Drawing Sheets

METHOD AND DEVICE FOR DETECTING THE CONTOUR OF A BODY

The invention concerns a method for at least regional determination of an outer contour of a body, in which a contour element, which at least regionally surrounds the body, is formed according to an outer contour of the body.

The invention also concerns a device for at least regional determination of an outer contour of a body, which has at least one formable contour element.

Methods and devices of this type are used, for example, to determine the contour of the human body. However, various applications for determining the body contours of other living beings or objects are also known.

For example, DE-OS 25 06 295 describes the use of a modeling foil for determining the contour of a human arm. The foil is placed on a part of the section of arm to be molded and removed after suitable hardening has occurred. The surface contour of the arm is permanently captured in this way. Accordingly, this is a molding principle similar to a plaster of paris cast, except that in this case a foil or plastic is used.

EP 0 128 146 describes a measuring device in which a front and a back contact element are connected with each other by measuring tapes. Strain of the measuring tapes is electrically detected with the use of strain gauges. A device of this type is relatively expensive to produce, and multiple use by different persons is either objectionable for hygienic reasons or requires considerable disinfection expense.

DE-OS 199 56 574 describes contour determination with the use of an optical scanner. This is a technically very complicated device that is installed in preselected places. In the case of measurement of the human body, the individual must go to the location of the measuring device; on the other hand, decentralized use, for example, in the home of the person to be measured, cannot be realized at acceptable expense.

The objective of the present invention is to improve a method of the type described above in such a way that decentralized use is possible simply and at low cost.

In accordance with the invention, this objective is achieved by storing the shape of the contour element in the state formed according to the contour of the body by modifying at least one material property of the contour element and, after elastic removal of the contour element from the body, by carrying out another manipulation of the contour element in such a say that the shape of the contour element in the state formed by the body is determined by evaluating the modified material property.

A further objective of the present invention is to design a device of the type specified above in such a way that it can be used by unskilled persons and that a low production cost is maintained.

In accordance with the invention, this objective is achieved by virtue of the fact that the contour element has at least one material property that stores a forming state, that the contour element has elastic material properties at least after the storage of the forming state, and that the stored forming state can be determined by measurement techniques.

The modification of at least one material property of the contour element in the state formed by the outer contour of the body makes it possible, after a suitable fixing of this material property, to remove the contour element from the body again and both to allow strong elastic deformation during the removal process and to tolerate a return of the contour element to its undeformed original state after removal of the contour element from the body.

For example, it is possible to use the contour element in the home of a user and then carry out an evaluation centrally at an evaluation center. In particular, we are thinking of use in connection with a shipment of clothing, since a significant problem here is that the shipped articles of clothing do not fit. The contour elements make it possible for each customer to make exact data on his body contour available to the shipper, so that this data can be made to conform with the manufacturing data of the give articles of clothing. In particular, this also makes it possible to take into consideration different patterns of different manufacturers with the same size specifications.

A determination of the modified material property can be made, for example, in such a way that an elastic deformation of the contour element is carried out at the central evaluation center until the stored material property signals that an elastic deformation that corresponds to the body contour during the performance of the original measuring operation is again present. The elastic deformation of the contour element that has been reproduced in this way can then be determined by any desired measuring technique, for example, optically or mechanically.

Simple manipulation can be assisted by deforming a foil-like contour element.

A combination of different material properties is facilitated by storing the material properties in a storage layer of a contour element with at least two layers.

Storage of the deformation state by the action of light is assisted by optically modifying the material properties of the contour element.

Storage of the contour information by, for example, the action of hot air or hot water is assisted by thermally modifying the material properties of the contour element.

One storage variant consists in storing the measurement information by effecting a color change in the contour element.

It is also possible for the material properties of the contour element to be modified by the action of air.

Another possible variant is modification of the material properties of the contour element by the action of pressure.

Long-lasting usability of the contour element is assisted by using a foil covering to protect the contour element in a ground state from parameters that alter its materials properties.

A comprehensive contour determination in one operation is made possible by designing the contour element to surround at least a considerable expanse of the body.

To facilitate the placement of the contour element, it is proposed that the contour element be designed to surround a segment of the body.

In accordance with another handling variant, it is also proposed that the contour element can be pulled onto at least a region of the body.

Convenient use by the user is assisted by providing the contour element with a closure that can be opened.

Embodiments of the invention are shown schematically in the drawings.

Figure 1:
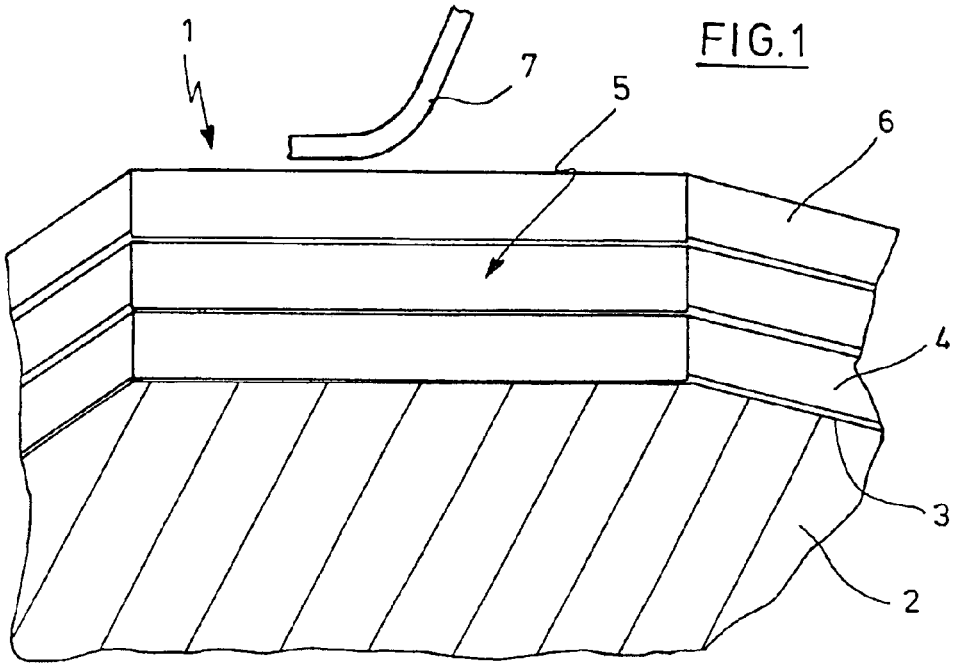
FIG. 1 shows a cross section through a multilayer contour element, which is elastically deformed by a body.

In accordance with the embodiment in FIG. 1, a contour element (1) is elastically deformed by a body (2). The contour element (1) rests on an outer contour (3) of the body (2). In the illustrated embodiment, the contour element (1) is designed with three layers. A bottom layer (4) lies below a storage layer (5), which is covered by a cover layer (6). In an initial state of the contour element (1), it is also possible to provide an additional protective layer (7) above the cover layer (6). In a design of this type, the protective layer (7) is pulled off the contour element (1) after the contour element (1) has been closely fitted to the outer contour (3) of the body (2).

At least one material that undergoes a change in at least one of its material properties when it is systematically acted upon is located in the region of the storage layer (5). For example, the material may be photosensitive or heat-sensitive; it is also possible to provide for sensitivity to air, in which case it must be possible to separate the cover layer (6) from the storage layer (5). It is also conceivable that an effect can be exerted by the absorption of water, drying, pressure, or other physical parameters.

Placement of the contour element (1) on the outer contour (3) of the body (2) can be effected, for example, by elastic deformation of tubular contour elements (1) or segments of the contour element (1). Placement on the body (2) is also possible with the use of zippers, Velcro fasteners, or other releasable fasteners. The realization of a concrete design depends on the body (2) to be determined, and other application requirements.

Basically, a procedure can be carried out in such a way that, in a first step, the contour element (1) is deformed by the outer contour (3) of the body (2), and that, in this state of deformation, the storage layer (5) is modified in such a way by the action of an external parameter, for example, a physical or chemical parameter, that storage information with respect to the present state of deformation is present. This storage information does not change even in the event of subsequent further deformation or restoration. After the contour element (1) has been removed from the body (2), this makes it possible to carry out a re-deformation of the contour element (1) at an evaluation center in such a way that the original state of deformation is determined. In another variant, the modified material properties of the storage layer (5) are determined by measurements without renewed elastic deformation of the contour element (1), and this information is used to make a numerical determination of the stored state of deformation.

Figure 2:
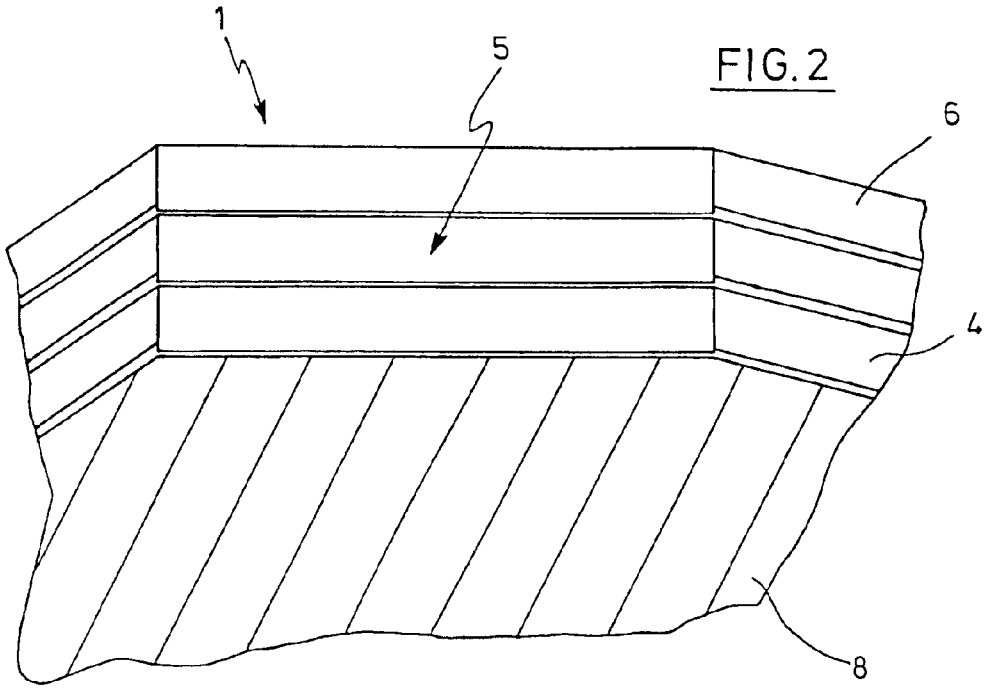
FIG. 2 shows the contour element in FIG. 1 during a re-deformation to determine an original state of deformation by measurement techniques.

FIG. 2 shows a design variant in which re-deformation of the contour element (1) is carried out at an evaluation center until the storage layer (5) detects agreement with the original deformation that occurred when the contour element (1) was placed on the body (2) as shown in FIG. 1. The re-deformation in accordance with FIG. 2 may be carried out, for example, mechanically over a deformation body (8), but hydraulic or pneumatic deformations are also conceivable. In general, a deformation body (8) may be constructed from a large number of individual body segments, which are deformed independently of one another, for example, by pneumatic or hydraulic control, until the information in the storage layer (5) signals agreement with respect to shape with the outer contour (3) of the body (2).

Figure 3:
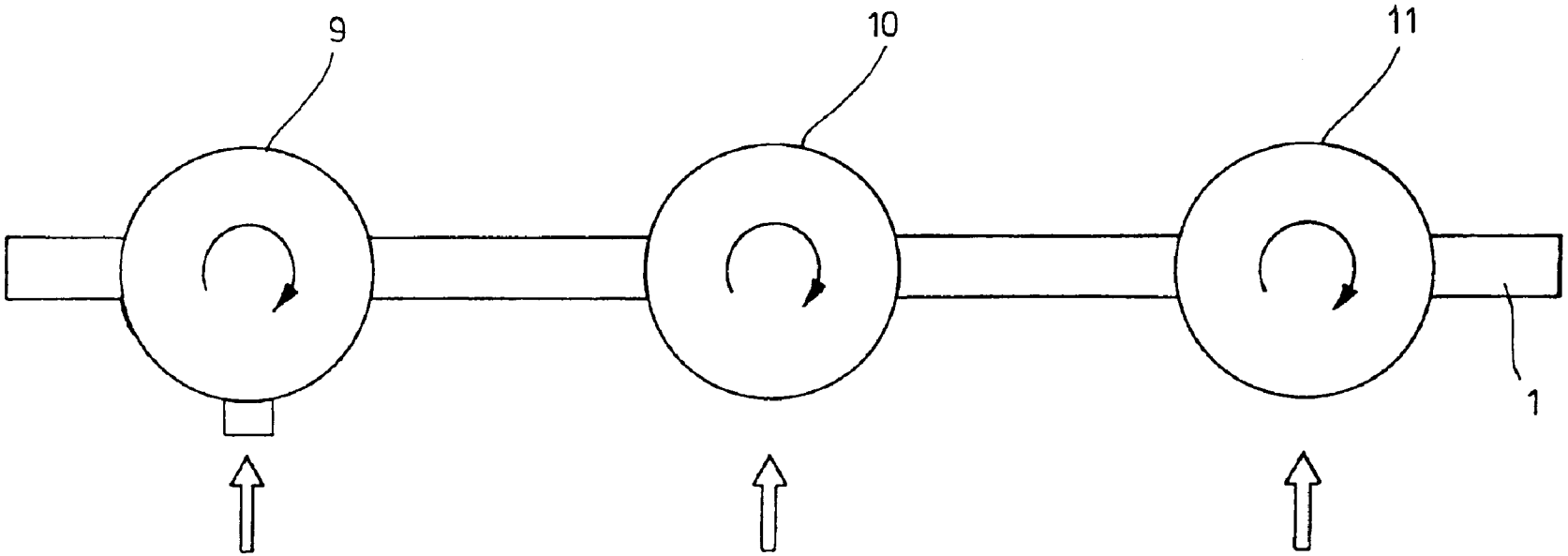
FIG. 3 is a schematic representation of a manufacturing operation for the manufacture of a multilayer contour element.

FIG. 3 illustrates a typical manufacturing process for a multilayer contour element (1). A closure device is possibly attached to the contour element (1) at processing station (9), the storage layer (5) is applied at processing station (10), and the cover layer (6) is applied at processing station (11). In embodiments with an additional protective layer (7), an additional processing station is used.

Figure 4:
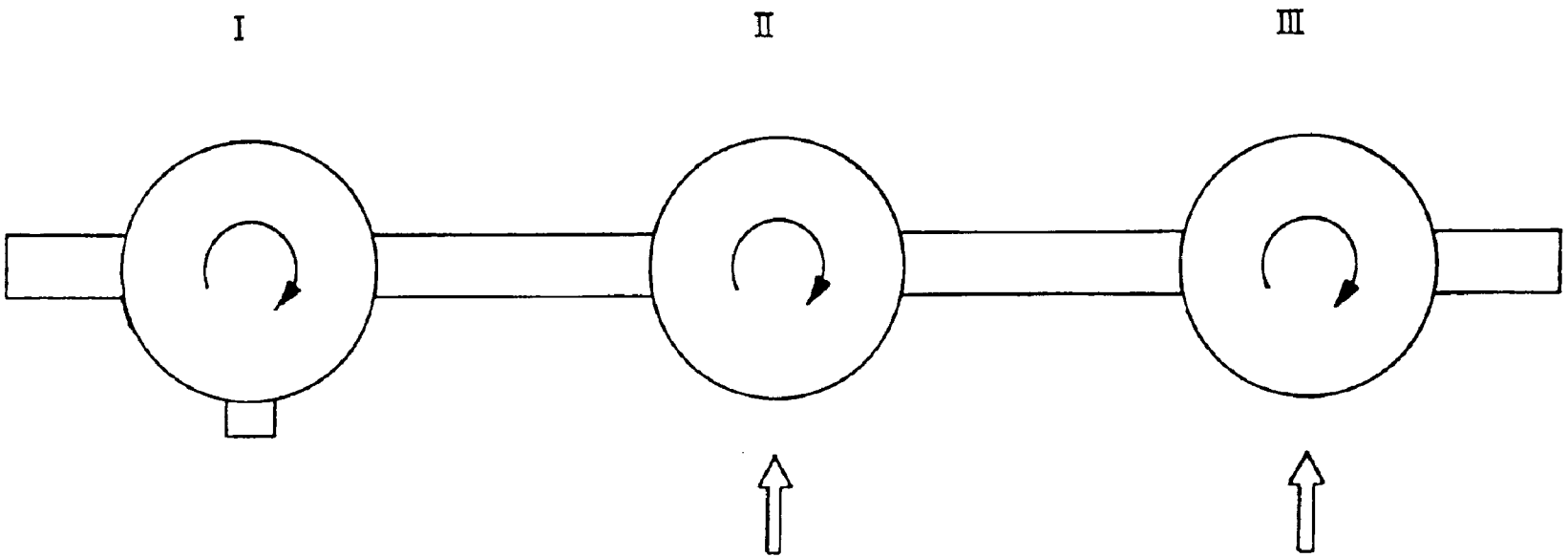
FIG. 4 is a schematic representation of the basic process steps involved in carrying out the contour determination and the subsequent evaluation by measurement.

FIG. 4 once again illustrates the main process steps in the determination of the outer dimensions of the body (2). In process step I, the contour element (1) is placed on the body (2), a fastener (if present) is fastened, the contour element (1) undergoes elastic deformation by the outer contour (3) of the body (2), and the contour information is stored in the storage layer (5). In process step II, the contour element (1) is restored with the use of the deformation body (8), and the information in the storage layer (5) is evaluated with the use, for example, of pneumatic or optical systems. During process step III, the dimensions are taken from the deformed contour element (1) by suitable measuring devices.

Alternatively or additionally to storage of a state of deformation, it is also possible to provide the storage layer (5) with information on a current state of stress of the material and in this way obtain a stress fixation. Regardless of how the stored data is defined, storage is possible by both physical and chemical parameters of the storage layer (5).

In regard to the use of the contour elements (1) in connection with the management of a mail-order business, the contour element (1) is first sent to the end customer, who can then put on the contour element (1) to document his body shape by the designated modification of the storage layer (5). The contour element (1) is then sent back to a suitable evaluation facility for evaluation of the information contained in the storage layer (5). The customer body data obtained in this way can then be used to send systematically fitted articles of clothing to the customer, to allow optimum assignment of ready-made clothing, or to assist in the production of custom-made clothing. Returns of articles of clothing due to poor fit can be avoided in this way. Assignment of the individual customer data to the individual manufacturing data can be performed with the use of a data bank.

In accordance with another embodiment, it is possible to arrange measuring tapes marked with different colors in a sample article of clothing, for example, a sock, in such a way that they occupy measuring positions that are critical for a determination of a specific body contour. After activation of the measuring tapes, for example, thermally with the use of a hair drier, shrinking occurs according to the contour curvature of the given body (2). After shrinking has occurred, the measuring tapes are removed from the sample article of clothing, and only these measuring tapes are sent to the assigned evaluation center. The sample article of clothing, on the other hand, is retained by the person and may, for example, be presented to the person as a token of appreciation for the activity he has performed. In the determination of a foot contour, we have in mind, specifically, that both feet be determined by this measuring technique. This makes it possible to make a size comparison. The length of the shrunk measuring tapes is evaluated at the evaluation center by conventional techniques for measuring length.

In accordance with another embodiment, it is possible to spray on a suitable substance. Furthermore, it is also possible to use shrink film, for example, undergoes shrinkage when heated.

In accordance with another embodiment, it is possible to make the contour determination with the use of a flat material that is provided with special gathering elements. Pulling on these gathering elements, which, for example, may be designed as threads, causes gathering of the flat material, so that it fits the contour of the body whose contour is to be determined.

It is also possible to use a flat material that can be adapted in its contour to the contour of the body (2) to be determined by crimping it. Both in the case of gathering and in the case of crimping, it is possible to carry out a fixation after the state adapted to the contour has been captured and then to carry out a measuring operation and the associated data acquisition. The contour determination can be made, for example, by a determination of the tensile stresses present after the gathering or crimping.

In accordance with another embodiment, the given contour data is acquired at the site of use, and the data is stored on a suitable data storage medium. Only this data storage medium is then returned to the central evaluation center. Shipping expenses can be reduced in this way. For example, electrical acquisition of the given contour data and storage, e.g., on a special chip card, are possible.

Another embodiment consists in placing two materials that are different from each other one above the other. At least one of these materials is provided with a reactive substance. The reactive substance can be activated by the contact of the materials with each other or by an external influencing parameter.

Another variant consists in providing the contour element (1) with a so-called shape memory. A corresponding storage process can be carried out by transformation steps from elastic to nonelastic and then back to elastic, or from nonelastic to elastic and then back to nonelastic.

It is further possible to place microencapsulated or nanoencapsulated adhesives in the contour element (1), which, for example, are stored in a two-chamber system. Contact of the adhesive components with one another is then brought about by the application of pressure or heat. The storage of the contour can then be brought about by hardening of the adhesive.

In another possible design variant, when the user uses the contour element (1), a chemical is supplied in a controlled way from a gel, and the supply of this chemical results in a charge in the pH, which triggers a first deformation. This first deformation results in the storage of the body dimensions of the user. When the pH is changed again in the opposite direction, the contour element (1) is restored to the original dimensions and shipped in this form. By triggering the first pH change again, the contour element (1) can be returned to the form in which the body dimensions are stored. Later determination of the body dimensions at the site of the measurement can be carried out without any problems with the use of these sequences.

What is claimed is:

1. Method for at least regional determination of an outer contour of a body, in which a contour element, which at least regionally surrounds the body, is elastically formed according to an outer contour of the body, wherein the shape of the contour element (1) in the state formed according to the outer contour of the body (2) is stored by modifying at least one material property of the contour element (1) and, after elastic removal of the contour element (1) from the body (2), another manipulation of the contour element (1) is carried out in such a way that the shape of the contour element (1) in the state formed by the body (2) is determined by evaluating the modified material property.

2. Method in accordance with claim 1, wherein a foil-like contour element (1) is formed.

3. Method in accordance with claim 1, wherein the material properties are stored in a storage layer (5) of a contour element (1) with at least two layers.

4. Method in accordance with claim 1, wherein the material properties of the contour element (1) are optically modified.

5. Method in accordance with claim 1, wherein the material properties of the contour element (1) are thermally modified.

6. Method in accordance with claim 1, wherein the measurement information is stored by effecting a color change of the contour element (1).

7. Method in accordance with claim 1, wherein the material properties of the contour element (1) are modified by the action of air.

8. Method in accordance with claim 1, wherein the material properties of the contour element (1) are modified by the action of pressure.

9. Method in accordance with claim 1, wherein the contour element (1) is protected in a ground state from parameters that alter its materials properties by the use of a foil covering.

10. Method in accordance with claim 1, wherein the contour element (1) is elastically deformed before its material property is modified.

11. Method in accordance with claim 1, wherein the contour element (1) is elastically deformed again during the performance of the measurement evaluation.

12. Method in accordance with claim 1, wherein the contour element (1) is shipped in the formed state from the site of acquisition of the measurement data to the site of evaluation of the measurement data.

13. Method in accordance with claim 1, wherein the evaluation of the measurement data is performed in the local vicinity of the measurement data acquisition.

14. Device for at least regional determination of an outer contour of a body, which has at least one formable contour element, wherein the contour element (1) has at least one material property that stores a forming state, that the contour element (1) has elastic material properties at least after the storage of the forming state, and that the stored forming state can be determined by measurement techniques.

15. Device in accordance with claim 14, wherein the contour element (1) is in the form of a foil.

16. Device in accordance with claim 14, wherein the contour element (1) is designed with at least two layers.

17. Device in accordance with claim 14, wherein the contour element (1) has photosensitive properties at least regionally.

18. Device in accordance with claim 14, wherein the contour element (1) has properties that can be thermally influenced at least regionally.

19. Device in accordance with claim 14, wherein the contour element (1) has properties that can be influenced by the action of air at least regionally.

20. Device in accordance with claim 14, wherein the contour element (1) has properties that can be influenced by the action of pressure at least regionally.

21. Device in accordance with claim 14, wherein the contour element (1) is designed to surround at least a considerable expanse of the body (2).

22. Device in accordance with claim 14, wherein the contour element (1) is designed to surround a segment of the body (2).

23. Device in accordance with claim 14, wherein the contour element (1) can be pulled onto at least a region of the body (2).

24. Device in accordance with claim 14, wherein the contour element (1) has a closure that can be opened.

25. Device in accordance with claim 14, wherein the contour element (1) is provided with a cover foil that can be removed for use.

26. Device in accordance with claim 14, wherein the contour element (1) has at least one pull element for carrying out a gathering operation.

27. Device in accordance with claim 14, wherein the contour element (1) has at least one pull element for carrying out a crimping operation.

28. Device in accordance with claim 14, wherein the contour element (1) can be connected to a device for acquiring and storing contour data.

29. Device in accordance with claim 14, wherein the contour element (1) is formed at least in part from a layer that is sprayed on.

30. Device in accordance with claim 14, wherein the contour element (1) is provided with at least one reactive substance.

31. Device in accordance with claim 14, wherein the contour element (1) is provided with a shape memory.

32. Device in accordance with claim 14, wherein the contour element (1) has at least one encapsulated adhesive.

33. Device in accordance with claim 14, wherein the contour element (1) has at least one substance whose pH can be changed.

* * * * *